US005464377A

United States Patent [19]

Beeman

[11] Patent Number: 5,464,377

[45] Date of Patent: Nov. 7, 1995

[54] STRIKING TARGET FOR MARTIAL ARTS

[76] Inventor: Stephen E. Beeman, 3881 S. Nova Rd., Port Orange, Fla. 32127

[21] Appl. No.: 221,108

[22] Filed: Mar. 31, 1994

[51] Int. Cl.[6] ..... A63B 69/00

[52] U.S. Cl. ..... 482/83; 273/55 R; 482/86

[58] Field of Search ..... 482/83–90; 273/348, 273/367–370, 386, 390, 407, 127 B, 55 B, 55 R, 55 A, 26 R; 128/25 R; 434/247, 257, 256

[56] References Cited

U.S. PATENT DOCUMENTS

| | | | |
|---|---|---|---|
| 1,199,278 | 9/1916 | Koch | 482/83 |
| 3,304,089 | 2/1967 | Smith | 273/55 R |
| 4,093,212 | 6/1978 | Jacques | 482/83 |
| 4,807,871 | 2/1989 | Bryson | 273/55 R |
| 5,342,267 | 8/1994 | Adams et al. | 482/83 |

*Primary Examiner*—Stephen R. Crow
*Assistant Examiner*—Jerome Donnelly
*Attorney, Agent, or Firm*—Robert L. Wolter; Maguire, Voorhis & Wells

[57] ABSTRACT

A striking target for use in the practice of martial arts including a semi-cylindrical base frame secured to a foundation with the base frame having an upper rim forming a track extending in a substantially horizontal plane. An elbow shaped pivot arm is pivotally mounted radially inward of the track an has a horizontal extension extending over the track and adapted to engage and traverse the track. At least one cam surface is integral the track to form a raise or protuberance and inhibit the movement of the pivot arm across the track. A resilient member is attached to the pivot arm to oppose the force applied to the target member by striking it.

21 Claims, 2 Drawing Sheets

STRIKING TARGET FOR MARTIAL ARTS

BACKGROUND OF THE INVENTION

This invention relates generally to the field of athletic practice equipment and more particularly to those devices used for practicing striking and kicking in the field of martial arts.

Generally the different striking devices used in practicing martial arts utilize a padded target. Typically, the target pivots and are biased to offer resistance against a striking force. The padded targets are often attached to large and bulky frames and may not necessarily be suitable for the home environment. Other devices may require the assistance of a second person to stabilize or hold a target for each kick. Still other devices are not adapted to measure a user's performance and consequently there is no way to evaluate the progress of one's kicking proficiency.

In view of the foregoing, there is a need for a striking target or apparatus that is small enough to be used in the home without the aid of a second individual and also gauges a user's performance.

SUMMARY OF THE INVENTION

The primary object of the present invention is to provide a new and useful martial arts striking device that is small enough to use in the home environment and without a second individual. Still another object of this invention is to provide some means for gauging performance of a user of this device. Still another object of this device is to provide a striking apparatus that is easy to assemble.

The striking apparatus embodying the present invention and satisfying the foregoing objectives includes a striking member having a pad. The striking member is mounted to a frame having a rim forming a track and the striking member is adapted to traverse the track. The track has at least one cam surface and a resilient member is attached to the striking member to oppose the force applied by striking the target. When a user strikes the padded target with sufficient force the striking arm traverses the track in the direction of the striking force and across the cam surfaces where the arm comes to rest.

DESCRIPTION OF THE PREFERRED EMBODIMENT

Figure 2:
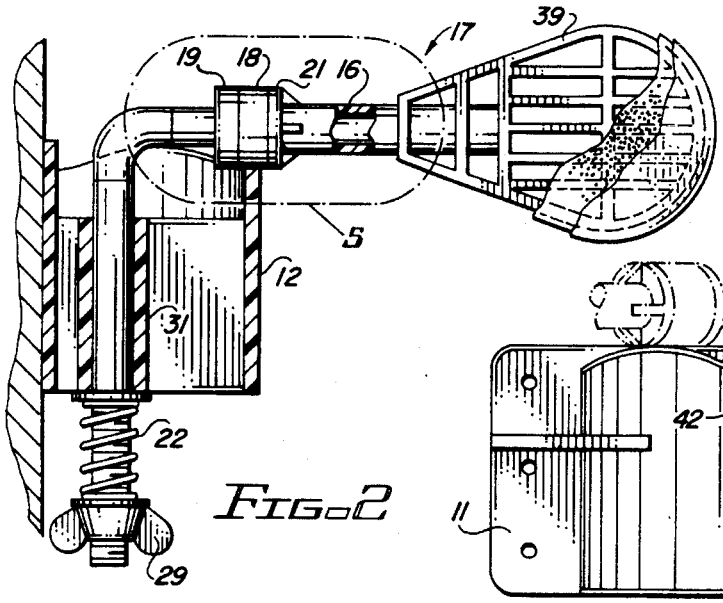
FIG. 2 is a cross-sectional side view, taken along line 2—2, of the striking member mounted in a mounting frame.
Figure 4:
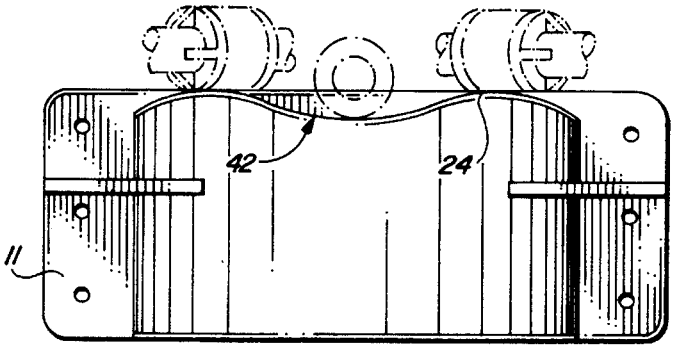
FIG. 4 is a frontal view of the base of the striking apparatus showing movement of the pivot arm.
Figure 5:
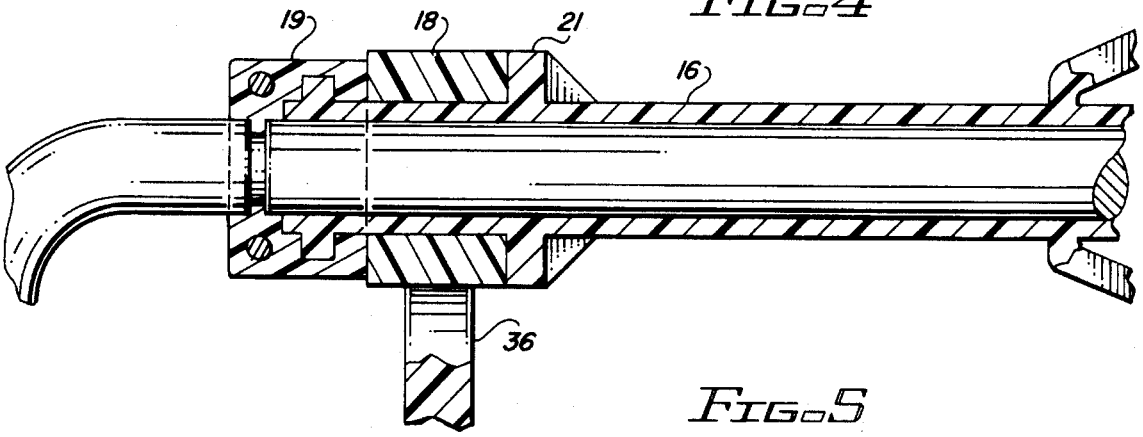
FIG. 5 is a cross-section of the striking member taken from insert 5 of FIG. 2.
Figure 7:
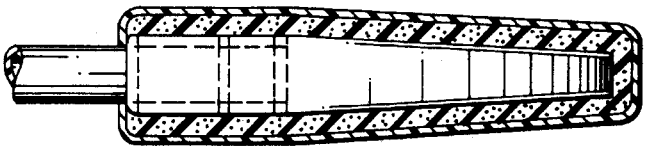
FIG. 7 is a sectional view of the padded target.

Referring now to FIGS. 2, and 4 there is illustrated an embodiment of a martial arts striking device generally indicated as 10. This device includes a striking member 13 mounted in a mounting frame 15. The mounting frame 15 may include a mounting plate 11 with an attached semi-cylindrical base 12. The rim of the base 12 forms a track 36 and the striking member 13 is adapted to traverse the track 36. The two cam portions 24 are integral with the base 12 and form raises or protuberances in track 36. These cam portions 24 are symmetrically aligned to form a valley 42 at the apex of base 12. The cam portions 24 are present to inhibit the movement of the striking member 13 along the track 36 and, as later explained, assist in a user's evaluation of his/her proficiency in using the striking apparatus.

Figure 1:
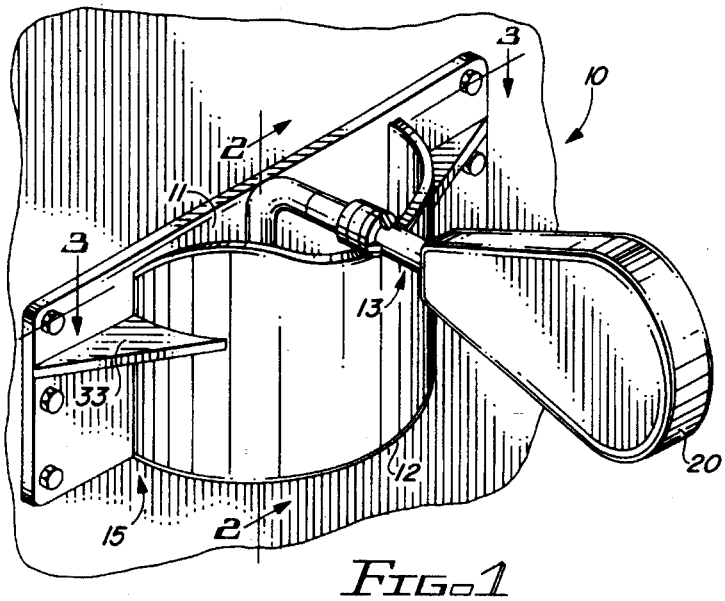
FIG. 1 is a perspective view of the striking apparatus.
Figure 3:
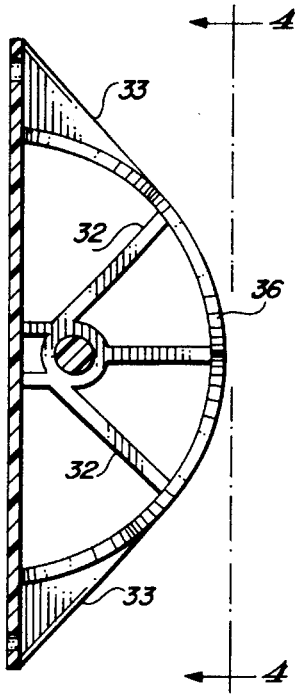
FIG. 3 is a top view of the base.

As shown in FIGS. 1–3, base 12 is secured to the mounting plate 11 by the outer gussets 33. A sleeve 31 is fixed to the base 12 by the inner gussets 32 and offset from the mounting plate 11 by members 34. The entire mounting frame 15 is preferably manufactured through injection molding of a nylon plastic, such as Isoplast manufactured by Dow Chemical Company, so the plate 11 and base 12, gussets 32 and 33 with the sleeve 31 are integrally united. The mounting plate 11 is approximately 4¾ inches high and the base 12 with the cam portion 24 is preferably the same height. The apex of the base 12 is approximately 4 inches from the plate 11.

Figure 6:
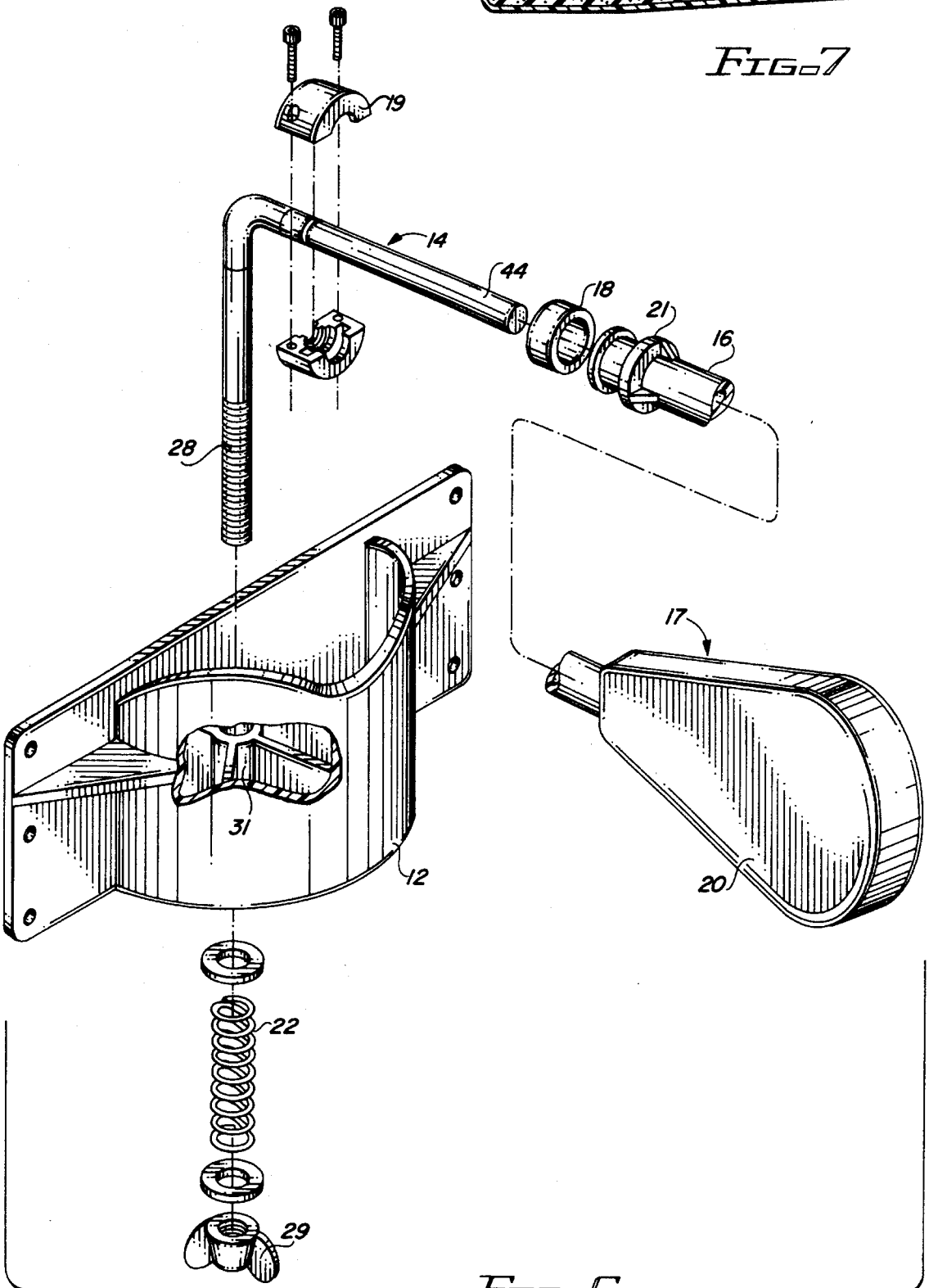
FIG. 6 is an expanded perspective view of the striking apparatus.

The striking member 13, shown in FIG. 6, consists of a stainless steel pivot arm 14 in the shape of an elbow having a threaded section 28 at its base, and a padded target 20 at its opposite end. The threaded section 28 of the arm 14 is inserted in sleeve 31 with the threaded section 28 extending below the sleeve 31 to receive spring 22. The spring 22 is secured on the pivot arm 14 by wing nut 29, and abuts the bottom of sleeve 31 of the base 12. The wing nut 29 is adjustable along the longitudinal axis of section 28 of the pivot arm 14 to selectively adjust the tension of the spring 22 and regulate the resiliency of the striking member 13.

The pivot arm 14 has an insert 44 that fits in a paddle 17 having the padded target 20. The insert 44 should be mounted in paddle 17 to prevent any annular movement of the paddle 17 on insert 44 when a user strikes the padded target 20. One embodiment includes machining insert 44 to form a single flat surface, and paddle 17 includes a corresponding interior flat surface. When these two surfaces are aligned, paddle 17is not able to rotate on insert 44.

Flange 21 is secured on the target sleeve 16 in spaced relation to the base 12 as shown in FIGS. 1 and 2. A rotating collar 18 is fitted over the pivot arm 14 and locked against the flange 21 by the locking collar 19 such that when the striking member 13 is mounted into the base 12 the roller rests on the track 36 so the pivot arm 14 freely traverses the track 36 of base 12. Also shown in FIG. 6 is the locking collar 19 with two halves; each half is machined to fit the contours of the junction between the paddle 17 and arm 14. The collar 19 clamps the paddle 17 and arm 14 together when the two halves of the locking collar are united. The rotating collar fits on the paddle 17 intermediate the locking collar 19 and flange 21 and rotates freely around the paddle so pivot arm 14 may traverse the track 36. This invention is not intended to be limited to this specific locking device, but includes basically any device that will hold the rotating collar 18 in place on the track 36.

A form 39 for the target 20 is mounted on the sleeve 16. The form 39 has foam padding attached thereon dipped in latex to form the padded target 20. A plastic cover may also be sewn or otherwise fitted over the foam. The entire paddle 17 with the form is preferably formed by injection molding to form a single integral unit, but the form 39, sleeve 16 and rib 5 may be separate units.

In assembling striking apparatus 10, the mounting frame 15 is secured to a stable frame or other foundation. The section 28 of pivot arm 14 is inserted into the sleeve 31 of the base frame 12 so the rotating collar 18 rests on the track 36 of the base 12 intermediate cam portions 24. The pivot arm 14 holds the padded target 20 a sufficient distance from the base 12 to enable a user to strike the target 20. Spring 22 is fitted over the threaded section 28 of the pivot arm 14 to abut sleeve 31. A washer is preferably placed between spring 22 and sleeve 31 to secure this fit. A wing nut 29 is also fitted on the vertical section 28 below the spring 22 holding the spring on said pivot arm 14.

The wing nut 29 is adjustable along the longitudinal axis of the threaded section 28 of the pivot arm 14. This enables a user to selectively adjust the tension in the spring and, accordingly, regulate the force necessary for a user to strike the target and force the striking member 13 from the valley 42 across the track 36 and over a cam portion 24. After the target member 13 pivots over a cam portion 24 and comes to rest, the user pulls the target member back to its original position between cam portions As the wing nut 29 is adjusted vertically upward, this increases the tension in the spring requiring additional force to overcome the cam portions 24. The user may use this adjustment mechanism to monitor his/her performance. By way of example, the tension in the spring is adjusted to a point where the user is unable to overcome the cam portions 24. The user practices at this level until he/she is able to strike the pad and overcome the cam portions 24. When the user reaches-this level, the wing nut 29 is marked as a reference point. With these reference points the user monitors his/her proficiency.

While I have disclosed the preferred embodiment of my invention, it is not intended that this description in any way limits the invention, but rather this invention should be limited only by a reasonable interpretation of the now recited claims.

What I claim is:

1. A striking target for practicing athletics, comprising:

(a) a mounting frame having a rim forming a track said mounting frame including a mounting plate and a semi-cylindrical base plate mounted to said mounting plate extending outward therefrom, said semi-cylindrical base plate having a top surface defining the rim of said mounting frame having the track;

(b) at least one cam portion integral the track of said mounting frame forming a protuberance in said track;

(c) a striking member, adapted to traverse said track mounted to said mounting frame radially inward of the track on the semi-cylindrical base plate extending over the track of said semi-cylindrical base plate beyond the circumference thereof for striking; and, (d) a resilient member connected to said striking member to apply an opposing force against a force applied by the striking member.

2. A striking target as defined in claim 1 wherein said striking target further includes means for selectively adjusting the opposing force of said resilient member.

3. A striking target as defined in claim 1 wherein said striking member, comprises:

(a) an elbow-shaped pivot arm pivotally mounted to said mounting frame extending over and engaging the track of said pivot arm and adapted to traverse the track; and (b) a padded target attached to the end of the pivot arm distal the the connection of the elbow-shaped pivot arm to the mounting frame.

4. A striking target as defined in claim 3 further including a rotating collar on the pivot arm engaging the track of the base to enable said pivot arm to traverse the track.

5. A striking target as defined in claim 3 wherein the end of said pivot arm distal the padded target is inserted in a sleeve member that is mounted to the mounting frame radially inward of the track.

6. A striking target as defined in claim 3 wherein said mounting frame includes a sleeve suspended radially inward of the base plate of the mounting frame for receiving the pivot arm.

7. A striking target as defined in claim 6 wherein said resilient member is a tension spring fitted over the end of the pivot arm and abutting the bottom of the sleeve of the mounting frame.

8. A striking target for practicing athletics., comprising:

(a) a mounting frame having a rim forming a track;

(b) a striking member for striking, secured to the mounting frame and adapted to traverse said track;

(c) a resilient member connected to said target member to oppose a striking force applied to the striking member;

(d) two cam surfaces in said track, each said cam surface spaced apart from the other cam surface forming two spaced apart raises or protuberances in said track with said striking member in a starting position intermediate said cam surfaces before striking thereof to inhibit the movement of the striking member across said track; and, (e) means, mounted to the striking for engagement with said track and adapted to rotate on said striking member and roll across said track.

9. A striking target as defined in claim 8 wherein said mounting frame, includes a mounting plate and a semi-cylindrical base plate having a top surface defining the rim and track of the mounting frame, wherein the striking member is mounted radially inward of the track and extends over the track of said base plate beyond the circumference thereof for striking.

10. A striking target as defined in claim 9 wherein said striking member includes:

(a) an elbow shaped pivot arm having a first extension pivotally secured to said mounting frame radially inward of the track of the frame, and a second extension extending over the track and adapted to traverse the track on the mounting frame; and, (b) a padded target attached to the end of the second extension of the pivot arm beyond the circumference of the track.

11. A striking target as defined in claim 9 further including a rotating collar secured to the pivot arm to engage the track for the striking member to traverse said track.

12. The striking target as defined in claim 10 wherein said second extension on the pivot arm is fitted in a sleeve member having the padded target mounted thereon distal the track, and opposite that end of the striking member mounted to the frame.

13. A striking member as defined in claim 10 wherein said mounting frame includes a sleeve suspended radially inward of the semi-cylindrical base for receiving the first extension of said pivot arm.

14. A striking member as defined in claim 12 wherein said resilient member is a tension spring fitted over the first extension of the pivot arm and abutting the bottom of the sleeve of said mounting frame.

15. A striking target for practicing athletics, comprising:

(a) a mounting frame having a rim forming a track with two opposite directions of travel along the longitudinal axis of the track;

(b) a striking member secured to said mounting frame in a first starting position before striking, and adapted to engage and traverse the track along either of the two directions of travel along the track;

(c) a cam surface in said track to inhibit the direction of travel of the striking member across the track in either of said directions of travel, from said first starting position; and, (d) a resilient member connected to the striking member to oppose a force applied by striking the striking member.

16. A striking target as defined in claim 15 wherein said target member includes:

(a) an elbow shaped pivot arm having a first section pivotally secured inward of said base plate and a second section integral said first section and extending outward therefrom over the track and adapted to engage and traverse said track; and, (b) a padded target attached to the end of said second section distal the said first action.

17. A striking target as defined in claim 16 further including a sleeve member secured radially inwardly of the semi-cylindrical base for receiving the first section of the pivot arm opposite the padded target.

18. A striking target as defined in claim 17 wherein said resilient member is a tension spring attached to the end of the pivot arm passing through the sleeve member and abutting the bottom of the sleeve.

19. A striking target as defined in claim 16 wherein said striking target further includes means for selectively adjusting the opposing force of said resilient member.

20. A striking target as defined in claim 16 further including a rotating collar secured to the second section extension to engage the track for movement of the pivot arm across the track.

21. A striking target as defined in claim 20 wherein said mounting frame includes a mounting plate and a semi-cylindrical base plate, mounted to the mounting plate and extending outwardly therefrom, said base plate having a top surface forming the track of said mounting frame, wherein said striking member is mounted radially inward of the track and extends over the track surface of said base beyond the circumference thereof for striking.

* * * * *